US005094067A

United States Patent [19]

Varga et al.

[11] Patent Number: 5,094,067

[45] Date of Patent: Mar. 10, 1992

[54] YARN RE-STRUCTURING METHOD AND APPARATUS

[75] Inventors: Andre Varga, Halifax; Harry Cripps, Heaton Mersey; William Oxenham, Leeds, all of Great Britain

[73] Assignee: Carding Specialists (Canada) Limited, Canada

[21] Appl. No.: 722,368

[22] Filed: Jun. 25, 1991

Related U.S. Application Data

[63] Continuation of Ser. No. 389,365, Aug. 3, 1989, abandoned.

[30] Foreign Application Priority Data

Aug. 4, 1988 [GB] United Kingdom ..... 8818537

[51] Int. Cl.[5] ..... D01H 7/92

[52] U.S. Cl. ..... 57/333

[58] Field of Search ..... 57/111 N, 309, 293, 57/400, 417, 332, 333, 350

[56] References Cited

U.S. PATENT DOCUMENTS

| | | | |
|---|---|---|---|
| 4,458,477 | 7/1984 | Raasch et al. | 57/417 X |
| 4,565,064 | 1/1986 | Iwasaki et al. | 57/417 X |
| 4,642,981 | 2/1987 | Shimano | 57/417 |
| 4,700,538 | 10/1987 | Varga et al. | 57/333 X |
| 4,803,838 | 2/1989 | Varga et al. | 57/333 X |

*Primary Examiner*—Joseph J. Hail, III

*Attorney, Agent, or Firm*—Fitzpatrick, Cella, Harper & Scinto

[57] ABSTRACT

This is disclosed a yarn re-structuring method and apparatus for modifying the structure of a spun yarn in order to improve its properties, in which the yarn is subjected to the action of successive false twisters in order to impart a permanent modification to the structure of the yarn, in which there is a tandem arrangement of first and second oppositely acting false twisters, with the first false twister acting to at least partially unwind the original twist in the yarn and the second false twister acting at least partly to restore or to increase the original twist in the yarn. This action on the spun yarn improves the properties of softness and bulkiness, while retaining acceptable performance of the yarn in other characteristics.

3 Claims, 2 Drawing Sheets

FIG. 3.
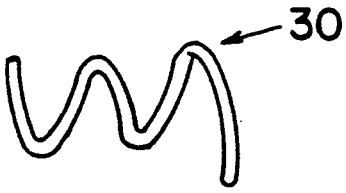
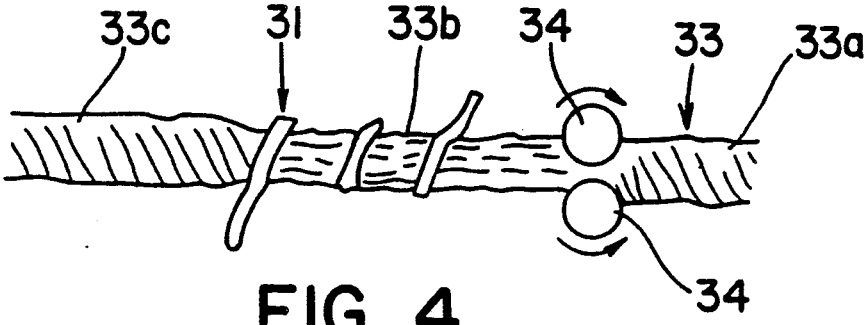
FIG. 4.
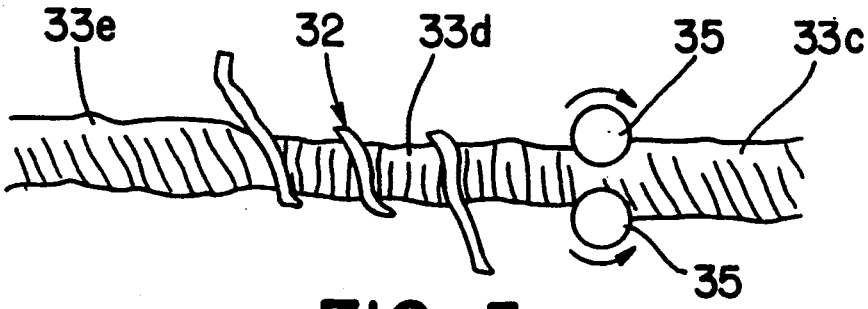
FIG. 5.

YARN RE-STRUCTURING METHOD AND APPARATUS

This application is a continuation of application Ser. No. 07/389,365 filed 8/3/89, now abandoned.

This invention relates to a yarn re-structuring method and apparatus for modifying the structure of a yarn in order to improve certain of its properties.

The invention has been developed primarily with a view to improving the properties of softness and bulkiness of a yarn, and especially of an open-end yarn (OE yarn).

BACKGROUND OF THE INVENTION

The open-end spinning process is now widely practiced, and in this process a flow of discrete fibers is fed by an airstream into a rotating spinning chamber and the fibers are deposited on an inner surface of the chamber. From that surface, they are picked-up by a tail end of yarn which is continuously withdrawn from the top or bottom of the chamber, the action forming a continuous yarn which has a true twist.

Many forms of apparatus are now known for performing the open-end spinning process, but without exception the yarns produced by this process have a very harsh feel, thereby limiting their end uses. In a number of cases, the degree of cleanliness that can be achieved in the yarn also leaves something to be desired.

The open-end spinning process introduces a true twist into a yarn, and the twist can be varied by varying the speed of the yarn delivery rollers relative to the rotational speed of the rotor.

Open-end yarns differ in many respects from ring-spun yarns; for example, OE yearns have excellent regularity, greater bulkiness, higher abrasion resistance, fewer imperfections and greater economy at lower counts. However, they do have inevitable defects, and particularly lower strength and a harsh feel, with the latter particularly limiting the end use in certain knitting requirements; the harsh or "sandy" handle leads to knitted fabrics from OE yarns being particularly unsuitable for use as underwear. In addition, it is known that the use of OE yarns causes a more rapid rate of wear of the needles of knitting machines, than do ring-spun yarns.

The harsh handle which results in the use of OE yarns can be attributed to the structure of the yarn, and especially to that of the surface fibers. In particular, it is believed that the tight surface fibers, including wrapper fibers and undulation of the yarn surface, are probably the main cause of harsh handle.

The present invention therefore seeks to provide an improved yarn restructuring method and apparatus which is particularly applicable to an OE yarn in order to improve certain of its properties, especially its harshness, without giving rise to unacceptable levels of performance in other aspects e.g. tensile strength. The invention is therefore based on the use of a false untwisting (and twisting) technique in a novel way in order to improve certain of its properties, while avoiding unacceptable reduction in operating performance of other characteristics of the yarn.

SUMMARY OF THE INVENTION

According to one aspect of the invention there is provided a method of modifying the structure of a spun yarn having a true twist and which comprises the steps of driving the spun yarn along a predetermined path of travel and subjecting the yarn to the action of successive false twisters in order to impart a permanent modification to the structure of the yarn, in which there is a tandem arrangement of first and second oppositely acting false twisters, with the first false twister acting to at least partially unwind the original twist in the yarn and the second false twister acts at least partly to restore or to increase the original twist in the yarn.

According to a further aspect of the invention there is provided apparatus for modifying the structure of a spun yarn having a true twist and comprising:

first storage or processing equipment for the yarn subsequent storage or processing equipment for the yarn spaced some distance from said first storage or processing equipment:

a path of travel for said yarn defined between the two sets of equipment: and, a tandem arrangement of first and second oppositely acting false twisters arranged along said path of travel with the first false twister being operative to at least partially unwind the original twist in the yarn and the second false twister being operative to at least partly restore, fully restore, or increase the original twist present in the yarn.

Thus, it has been found that the invention provides for improvement in the properties of softness and bulkiness of a spun year, especially of an OE yarn, while retaining acceptable performance of the yarn in other characteristics.

The invention is particularly suitable for use in restructuring a spun OE yarn, and usually the OE yarn will be supplied to the first false twister with a permanent Z-twist; as the yarn approaches the first false twister it will have at least partially untwisted Z-twist, a nil-twist or even an S-twist. The yarn as it leaves the first false twister comes under the influence of the second false twister, where Z-twist is applied to the yarn so as to restore or even increase the original Z-twist.

The combined action applied to the yarn by the first and second false twisters restructures and also cleans the fibers of the yarn, and this results in an increase in yarn diameter and a reduction in density, which contribute to a softer "handle" and also a reduction in harshness of the yarn.

It has been found in tests that variation in the properties of the restructured yarn can be obtained to suit different requirements, by varying the arrangement and operation of the first and second false twisters. Thus, the spacing-apart of the false twisters can be varied, and preferably in a range from immediately adjacent, and up to 50 mm spacing.

In one preferred embodiment, the first and second false twisters are pneumatic false twisters, and the air pressure supply to each false twister may be varied, and preferably the pressure supply to each false twister is independent of the other.

One particularly surprising aspec of the use of a tandem arrangement of false twisters operating in opposite directions is that the inclusion of the second false twister causes more violent restructuring of the yarn, which results in modifications to the softness of the yarn and increase in diameter thereof substantially, subject to appropriate choice of air supply pressures.

By selection of the separation of the first and second false twisters, and of the air pressures supplied to each false twister, a series of restructuring conditions can be obtained, with the resulting restructuring of the yarns with properties modified to suit a series of requirements for particular textile applications.

While the second false twister in the method and apparatus of the invention acts so as at least partly to restore the original twist in the yarn, in certain circumstances, and for certain uses of the re-structured yarn, it may be advantageous for the second false twister to be effective to go beyond restoration of the original twist in the yarn and in fact to add twist to the yarn of which at least some remains on a permanent basis. It is therefore within the scope of this invention for the action of the second false twister to be such as to restore and then to add twist to the yarn.

By way of example, a condition was chosen wherein the jets were separated by a 10 mm gap, the first false twister (an S-jet) was supplied with air at a pressure of 2.5 kg per square cm and the second false twister (the-Z-jet) was supplied with air at a pressure of 4.0 kg per square cm. Two rotor yarns were restructured as follows:

1. A 34's Ne hosery yarn spun from 100% cotton of 1 3/32 or 28 mm inch staple and:

2. An 8's Ne yarn spun from a blend of bleached cotton waste with 10% viscose fiber.

The restructured yarns (and the fabrics into which the yarns were knitted) were considerably softer both in handle and appearance. Also, the yarns appeared thicker after the restructuring process. Measurements of yarn bulkiness, made after the yarns were wound under constant tension, showed that the densities of the 34's Ne and 8's Ne yarns were substantially reduced. After treatment, the yarn densities has been reduced to 0.70 and 0.62 respectively compared to the densities of the yarns prior to restructuring.

A further particularly advantageous consequence of the restructuring process as applied in tests on the above examples of yarns, is in the appearance of enhanced uniformity. One of the samples initially had a periodic fault of a wavelength equal to the circumference of the rotor, and this fault was made far less obtrusive by the restructuring process: visually yarn irregularity was improved even when the air pressures supplied to the false twister jets were very low, that is 0.5 kg per square cm or less.

While pneumatic false twisters may be used in one preferred embodiment of the invention, it is not essential to use pneumatically operating false twisters, and a tandem arrangement of mechanical false twisters may be used in the invention i.e. false twisters which engage directly with the outer surface of the spun yarn as it travels through the false twisters in order to apply temporary alterations to the true twist originally present in the spun yarn.

Thus, in a further preferred embodiment of the invention, so-called spiral false twisters may be used, in which the diameter of the coils of the spiral formation of each false twister must be less than the diameter of the yarn which is being restructured, and also the distance between successive coils should be less than the staple length of fiber from which the yarn has been spun.

The efficiency of the false twisting action applied to the spun yarn may be improved by increasing the number of coils of each spiral.

Embodiments of method and apparatus according to the invention, for modifying the structure of a spun yarn, will now be described in detail, by way of example only, with reference to the accompanying drawings.

BRIEF DESCRIPTION OF DRAWINGS

FIG. 3 is a schematic side view of a spiral false twister which may be employed in a further embodiment of yarn restructing apparatus for use in carrying out a method according to the invention;

FIG. 4 is a schematic view of a spun yarn passing through a first one of a pair of oppositely acting spiral false twisters of the type shown in FIG. 3; and, FIG. 5 is a schematic view of a spiral false twister being used to temporarily increase the level of Z-twist in the yarn.

DESCRIPTION OF PREFERRED EMBODIMENTS

Figure 1:
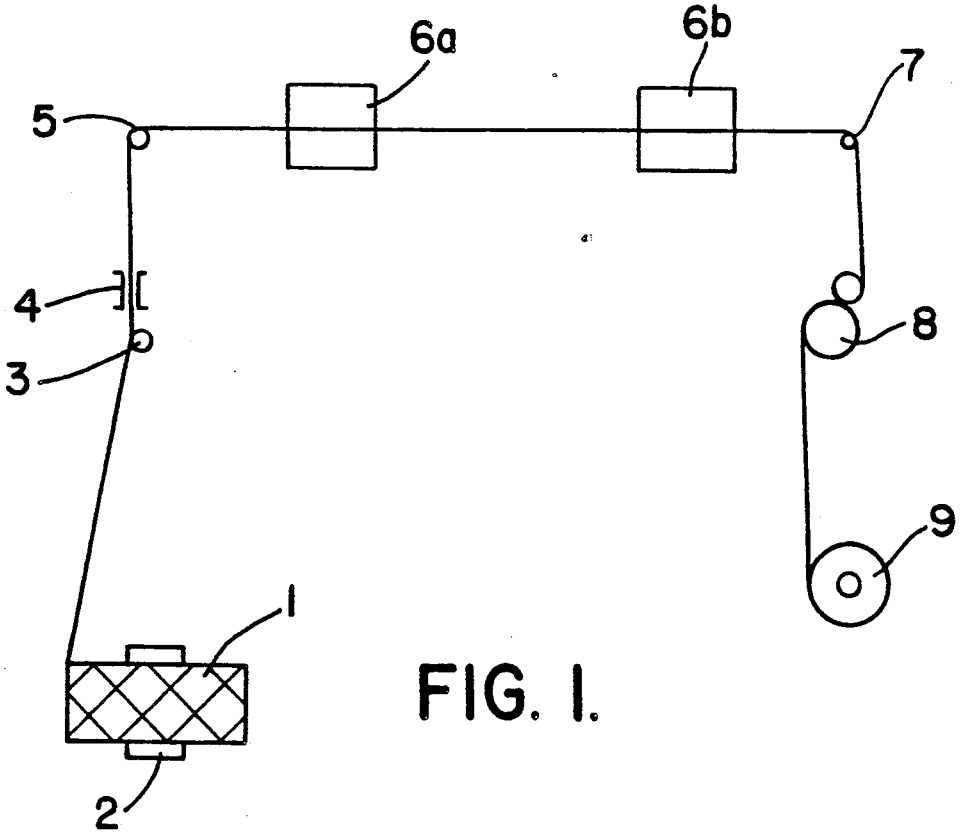
FIG. 1 is a diagrammatic illustration of the embodiment of yarn restructuring apparatus for use in carrying out a method according to the invention.

Referring now to FIG. 1 of the drawings, a package 1 of open-end spun yarn is supported at a supply station 2, and yarn is taken from the package through a yarn guide 3 and control tensioner 4 to a further guide 5. From the guide 5, the yarn passes along a predetermined path of travel in which it is subjected to the action of a tandem arrangement of false twisters which impart a permanent modification to the original structure of the spun yarn.

In this first embodiment, the tandem arrangement of false twisters comprises a first pneumatic false twister **6*a* and a second oppositely acting pneumatic false twister 6*b*, and the first false twister 6*a* acts so as to at least partially unwind the original twist in the yarn, whereas the second false twister 6*b*** acts so as to restore the original twist to the yarn or even to increase it.

After leaving the second false twister **6*b*, the restructured yarn then passes round a further guide 7 from which it is taken by delivery rollers 8 to a take-up package 9**.

In a pereferred method of carrying out the restructuring method of the invention, an OE yarn will be supplied to the first false twister **6*a*** with a permanent Z-twist, and upstream of the first false twister the twist in the yarn will be at least partially untwisted Z-twist, a nill twist or even an S-twist, depending upon:

the extent of original Z-twist in the spun yarn;
the internal arrangement of the false twister; and,
the pressure of air delivered to the false twister.

The yarn with its partly modified structure then passes to the second false twister **6*b***; upstream of the false twister the Z-twist is applied to the yarn so as to restore or exceed the original Z-twist.

The combined action applied to the yarn by the first and second pneumatic false twisters restructures and also cleans the fibers of the yarns, and this results in increase in yarn diameter and a reduction in density, which contribute to a softer handle and reduction in harshness. These improvements in these properties of the yarn can be obtained, without any unacceptable loss of performance in other characteristics of the yarn when intended for certain applications of textile use.

Figure 2:
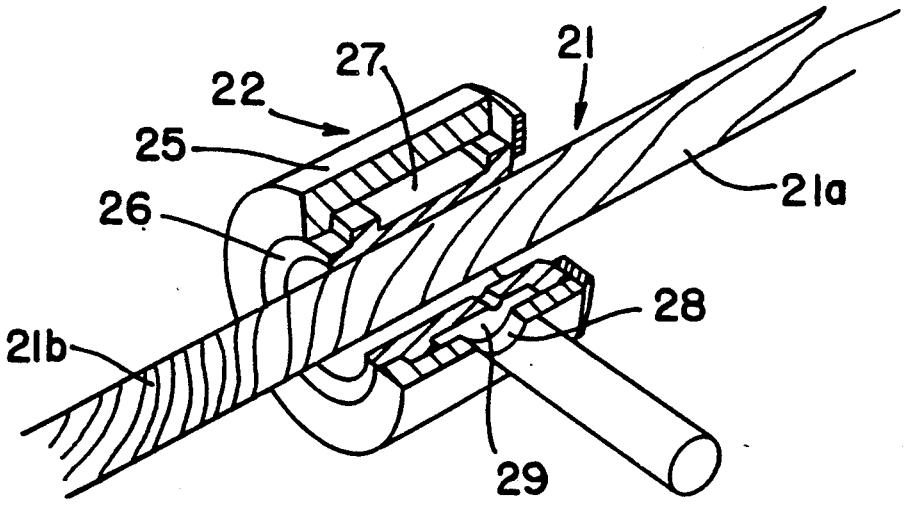
FIG. 2 is a schematic view of a yarn passing through a first one of a pair of oppositely acting pneumatic false twisters shown in FIG. 1.

Referring now to FIG. 2, this shows the action applied to a spun OE yarn (having an original internal and surface structure derived from the spinning process), by a pneumatic false untwister device 22. The device 22 comprises a jacket 25 within which is mounted a sleeve 26, the jacket and sleeve being shaped so that a plenum chamber 27 is formed between them. A port 28 to which a compressed air line may be connected extends through the jacket 25 to the interior of the plenum chamber. The sleeve 26 is formed with one or more passages 29 leading from the plenum chamber to the interior of the sleeve, the passages each being inclined at an acute angle to the axis of the sleeve. This means that the passages 29 are also each inclined at an angle to the radial plane so that air introduced into the sleeve will have a swirling motion at the axis of the sleeve, and will exert a false untwisting action on the yarn. In the illustrated arrangement, the real twist in the upstream section 21*a* of the yarn 21 is reduced to a lesser extent. By way of example, it can be assumed that the false untwister device 22 illustrates what happens upstream of the first false twister 6*a*, where the partly or wholely untwisted upstream portion of the yarn 21*a* may then pass to the second false twister 6*b* which is oppositely acting, and which therefore acts so as to wholely restore the original twist to the yarn 21 or indeed to increase the twist to a level somewhat above that of the original yarn.

It should be understood FIG. 2 is illustrative only, and that the upstream portion 21*a* of the yarn, before issue from the first false twister, may have zero twist, or even twist in an opposite direction, but during the subsequent oppositely acting effect of the second false twister 6*b*, the original real twist imparted to the spun yarn is wholely restored, and may indeed be increased to a level above that of the original yarn to suit certain applications.

The method and apparatus disclosed herein are particularly applicable to the re-structuring of OE spun yarns, but may also be used to advantage in the improvement of the properties of jet-spun and friction spun yarns.

The apparatus may be coupled-up, by way of example, to the delivery of an open-end spinner or the creel of a knitting machine or even the weft insertion unit of a loom.

The invention may also be used to re-structure 2-fold yarns, which may produce some interesting effects; modified yarns may also be produced from the Suessen Parafil and Plyfil systems. Also, yarns spun from man-made fibres (staple or continuous filament) or even wool or more exotic fibres may be re-structured to advantage using the method and apparatus according to the invention.

The first embodiment described above with reference to FIGS. 1 and 2 shows use of a tandem arrangement of oppositely acting pneumatic false twisters in a yarn reconstruction method and apparatus according to the invention. However, the use of pneumatically acting false twisters is not essential to this invention, and mechanically acting false twisters may be employed, i.e. in which the false twisters engage directly with the outer surface of the spun yarn as it travels through the false twisters in order to apply temporary alterations to the true twist originally present in the spun yarn. Therefore, a further preferred embodiment of the invention is shown in FIGS. 3 to 5, in which so-called spiral false twisters are used.

FIG. 3 shows in schematic form a spiral false twister 30 in greatly magnified form, and which is shaped somewhat like a normal spiral spring, as is known in the art. The internal diameter d of the passage defined through the spiral 30 must be less than the diameter of the yarn which is taken through the spiral false twister 30, so that the necessary mechanical false untwisting/twisting actions can take place via the successive spiral false twisters used in the apparatus. Also, the axial distance between successive coils of the spiral 30, shown by reference 1 in FIG. 3, should be less than the staple length of fibre from which the spun yarn has been formed. To improve the efficiency of the false twisting/untwisting action, the number of coils from which the spiral 30 is formed can be increased.

FIGS. 4 and 5 show successive oppositely acting spiral false twisters which will form a tandem arrangement used in a further embodiment of method and apparatus for restructuring a spun yarn.

FIG. 1 shows a tandem arrangement of false twisters 6*a* and 6*b*, which may be of the pneumatically acting type as shown in FIG. 2, or mechanical type as shown in FIGS. 3 to 5. It should be understood that further false twisters may be arranged in line e.g. 3, 4 or more, having different influencing effects, in order to produce the degree of restructuring desired. Therefore, the description herein of a tandem arrangement of oppositely acting (mechanical and pneumatic) false twisters is by way of example only. In FIGS. 4 and 5, there are shown examples of mechanical false twisters in the form of spiral false twisters.

In FIG. 4, there is shown an upstream spiral false twister 31, and FIG. 5 shows a downstream and oppositely acting spiral false twister 32. A spun yarn 33 is guided to pass through spiral false twister 31 by a pair of guide and feed rollers 34, and this causes the initially formed true Z-twist present in upstream portion 33*a* of the yarn 33 to be removed at least partly, as can be seen in the portion 33*b* of the yarn during transit from the feed rollers 34 and through the false twister 31. Depending upon requirements, part or all of the initial Z-twist can be removed, or all of the twist can be removed and some twist (S) may be applied.

The yarn 33 then passes from the false twister 31 via downstream yarn run 33*c* to feed rollers 35, as shown in FIG. 5, which guide and feed the yarn to pass through the second oppositely acting spiral false twister 32. The false twister 32 applies Z false twist to the yarn 33, via the action on the yarn taking place in section 33*d* and feeding back through portion 33*c*, and the restructured yarn then issues from the downstream end of spiral false twister 32 via downstream run 33*e*.

The use of spiral or other mechanical false twisters enables the same advantages of reconstruction of a spun yarn to be achieved, as can be obtained with the pneumatically acting false twisters of the first embodiment, though without the consumption of compressed air.

Spiral false twisters 31 and 32 are just one example of mechanical false twisters which can be used in the invention. Also, while there is shown an arrangement in which first false untwisting takes place, followed by false twisting, the invention also includes the case in which spun yarn may be restructured by first carrying out false twisting, followed by false untwisting. This can also provide advantageous restructuring of the spun yarn.

In addition, the use of feed rollers to feed the yarn through the false twisters/untwisters is not essential, and may be omitted.

We claim:

1. A method of modifying the structure of spun OE yarn having a permanent twist previously formed therein, said method comprising the steps supplying a spool of previously spun yarn having a permanent twist previously formed therein; driving a length of yarn from said spool along a predetermined path of travel, said yarn having a permanent twist previously formed therein twisted in a predetermined direction of rotation with respect to said path of travel, applying tension to said yarn in the direction of travel of the yarn downstream from the spool, and subjecting the yarn during passage along this path of travel, downstream of the point of applying tension, to the successive action of a tandem arrangement of first and second oppositely acting pneumatic false twisters, including the steps of applying a reversely acting false twist to the yarn in the first false twister in a direction of rotation opposite to said predetermined direction of rotation of the twist of the yarn in order to at least partially unwind the original twist in the yarn and thereby open up the fibers making up the yarn, and applying a false twist to the yarn in the second false twister, opposite to the false twist in the first false twister in the same direction as the predetermined direction of rotation of the twist of the yarn, to at least partly restore the original twist present in the yarn, to increase the diameter of the yarn and decrease the density of the yarn thereby improving the softness of the yarn.

2. A method according to claim 1 including the steps of varying the spacing apart of the false twisters and the air pressure supplied to each false twister thereby to vary the false untwisting/twisting action applied successively by the first and second false twisters and obtain a restructuring of the fibres of the yarn.

3. A method according to claim 2 wherein the first and second false twisters are spaced apart in a range from immediately adjacent up to 50 mm spacing apart.

* * * * *